US007951293B2

(12) United States Patent
Nibler et al.

(10) Patent No.: US 7,951,293 B2
(45) Date of Patent: May 31, 2011

(54) METHODS AND APPARATUS FOR A POOL TREATMENT AND WATER SYSTEM

(75) Inventors: David B. Nibler, Sonoma, CA (US); Emily R. Colomes, Canoga Park, CA (US); Peter W. Owenson, Sonoma, CA (US)

(73) Assignee: Zodiac Pool Systems, Inc., Moorpark, CA (US)

( * ) Notice: Subject to any disclaimer, the term of this patent is extended or adjusted under 35 U.S.C. 154(b) by 271 days.

(21) Appl. No.: 12/246,397

(22) Filed: Oct. 6, 2008

(65) Prior Publication Data

US 2009/0090665 A1 Apr. 9, 2009

Related U.S. Application Data

(60) Provisional application No. 60/978,047, filed on Oct. 5, 2007, provisional application No. 60/988,711, filed on Nov. 16, 2007.

(51) Int. Cl.
*E04H 4/12* (2006.01)

(52) U.S. Cl. ..... 210/167.11; 210/167.12; 210/181; 210/416.2

(58) Field of Classification Search ..... 210/167.01, 210/167.1, 167.11, 167.12, 167.13, 167.14, 210/175, 181, 416.1, 416.2
See application file for complete search history.

(56) References Cited

U.S. PATENT DOCUMENTS 179,698 A 7/1876 Hagar
432,248 A 7/1890 Rinman
797,152 A 8/1905 Sheckler
1,394,631 A 10/1921 Luschka et al.
1,528,449 A 3/1925 Meyer
1,748,898 A 2/1930 Peebles
1,820,020 A 8/1931 Hewitt
(Continued)

FOREIGN PATENT DOCUMENTS

GB 1372014 10/1974

OTHER PUBLICATIONS

Jandy Diatomaceous Earth Pool Filter, Jandy Installation and Operation Manual [online], Jandy Pool Products, Inc., May 17, 2006 [Retrieved on Dec. 4, 2008 from the internet: <URL: http://web.archive.org/web/20060517160114/http://www.jandy-downloads.com/pdfs/HO2388_revD.pdf> Entire document, especially p. 7, Fig. 3.

(Continued)

*Primary Examiner* — Fred Prince
(74) *Attorney, Agent, or Firm* — Dorsey & Whitney LLP

(57) ABSTRACT

A pool/spa water treatment system may include a pump and a pool filter. The pump may include a pump inlet and a pump outlet. The pump inlet and outlet may be aligned on a first axis or within a first vertical plane. The pool filter may be offset a select transverse distance from the pump. The pool filter may include a pool filter inlet in fluid communication with the pump outlet. The pool filter inlet and the pump outlet may be aligned on a second axis or within a second vertical plane that is transverse to the first axis or plane. The pool/spa water treatment system may further include a heater. The heater may include a heater inlet in fluid communication with the pool filter outlet. The heater inlet may be aligned with the pool filter outlet within the second plane.

20 Claims, 13 Drawing Sheets

U.S. PATENT DOCUMENTS 2,284,787 A 6/1942 Winkler
2,315,681 A 4/1943 Weisgerber
2,335,109 A 11/1943 Conery
2,615,397 A 10/1952 Conery
2,662,988 A 12/1953 McKim
2,882,828 A 4/1959 Hinckley
3,012,676 A * 12/1961 Englesberg ..... 210/94
3,078,998 A * 2/1963 Blumenfeld ..... 210/94
3,178,024 A 4/1965 Jacuzzi
3,420,376 A 1/1969 Smith
3,429,443 A 2/1969 Stern
3,493,116 A 2/1970 Edmiston
3,519,135 A 7/1970 Lerner
3,581,895 A 6/1971 Howard et al.
3,625,365 A 12/1971 Armstrong et al.
3,664,768 A 5/1972 Mays et al.
3,707,233 A 12/1972 Lerner
D227,565 S 7/1973 Ehret
3,747,768 A 7/1973 Barrera
3,767,050 A 10/1973 Reiner
3,774,772 A * 11/1973 Yeths ..... 210/456
3,779,387 A 12/1973 Day et al.
3,795,320 A 3/1974 Ehret
3,828,932 A 8/1974 Schneer
3,834,537 A 9/1974 Brett
D235,143 S 5/1975 Ehret
3,911,068 A 10/1975 Hamilton
3,929,151 A 12/1975 Rubin
3,957,644 A 5/1976 Edmonson
3,988,244 A 10/1976 Brooks
4,003,835 A 1/1977 Johnson
4,043,917 A 8/1977 Rowley et al.
4,105,555 A 8/1978 Pease
4,108,775 A * 8/1978 Wilkes et al. ..... 210/90
4,127,485 A 11/1978 Baker et al.
4,134,836 A 1/1979 Rowley et al.
4,169,793 A 10/1979 Lockshaw
4,283,281 A 8/1981 Cogan
4,421,643 A * 12/1983 Frederick ..... 210/138
4,537,681 A 8/1985 Argiropoulos et al.
4,601,822 A 7/1986 Zamburro
4,602,463 A 7/1986 Holowaty
4,627,118 A 12/1986 Baker
4,657,673 A 4/1987 Kessler
4,661,247 A * 4/1987 Weir et al. ..... 210/97
4,704,202 A * 11/1987 Poyner ..... 210/108
4,712,812 A 12/1987 Weir, III
4,798,670 A 1/1989 Treene
4,810,170 A 3/1989 Ide
4,822,077 A 4/1989 Hendrickson
4,861,466 A 8/1989 Leoncavallo et al.
4,869,817 A 9/1989 Mendoza et al.
4,894,149 A 1/1990 Block
4,923,601 A 5/1990 Drori
4,924,069 A 5/1990 Giordani
4,931,183 A 6/1990 Klein et al.
4,964,609 A 10/1990 Tomell
4,997,558 A 3/1991 Baker
5,000,488 A 3/1991 Albrecht
D316,741 S 5/1991 Kurth et al.
5,068,033 A 11/1991 Tobias et al.
5,087,357 A 2/1992 Villa
5,112,481 A 5/1992 Drori
5,188,727 A 2/1993 Kurth et al.
5,190,651 A 3/1993 Spencer et al.
5,222,525 A 6/1993 Munroe
5,240,593 A 8/1993 Moredock
D342,986 S 1/1994 Kurth
5,306,121 A 4/1994 Heflin et al.
5,328,604 A 7/1994 Drori
5,375,887 A 12/1994 Johnson
5,409,606 A 4/1995 Spencer
5,505,847 A 4/1996 Yamada et al.
5,524,860 A 6/1996 Ives
5,584,998 A 12/1996 Teter et al.
5,587,074 A 12/1996 Lynch et al.
5,653,831 A 8/1997 Spencer
5,656,159 A 8/1997 Spencer et al.
5,687,994 A 11/1997 Hansen
5,753,071 A 5/1998 Spencer
5,762,785 A 6/1998 Ruiz
5,882,515 A 3/1999 Lacy et al.
5,942,109 A 8/1999 Wuebker et al.
5,989,419 A 11/1999 Dudley et al.
6,029,942 A 2/2000 Daddis, Jr. et al.
6,036,853 A 3/2000 Spencer
6,156,213 A 12/2000 Dudley et al.
6,258,266 B1 7/2001 Riback et al.
6,280,619 B1 8/2001 Lacy et al.
6,287,466 B1 9/2001 Yassin
6,345,558 B1 2/2002 Wilson
6,450,782 B1 9/2002 Sakamoto
6,554,939 B1 4/2003 Murphy
6,582,613 B2 6/2003 Mooneyham
6,605,211 B1 8/2003 Slopack
6,695,970 B2 * 2/2004 Hornsby ..... 210/805
6,797,164 B2 9/2004 Leaverton
6,852,218 B2 * 2/2005 Vila Corts ..... 210/167.11
6,874,641 B2 4/2005 Clary
7,022,230 B2 4/2006 Imai et al.
7,081,200 B2 7/2006 Planas Valls
7,093,721 B2 8/2006 Imanse et al.
7,097,766 B2 8/2006 Moya
7,207,604 B2 4/2007 Wilson
7,294,262 B2 11/2007 Tadlock
7,794,591 B2 9/2010 Nibler et al.
7,815,796 B2 10/2010 Nibler et al.
2004/0057845 A1 3/2004 Skinner
2005/0002800 A1 1/2005 Kimura et al.
2005/0158185 A1 7/2005 Herrick et al.
2006/0124527 A1 6/2006 Goodwin et al.
2007/0045163 A1 3/2007 Meincke et al.
2007/0056903 A1 3/2007 James
2007/0163929 A1 7/2007 Stiles, Jr. et al.
2007/0227959 A1 10/2007 Sinur et al.
2008/0230454 A1 9/2008 Nibler et al.
2008/0230455 A1 9/2008 Nibler et al.
2009/0126915 A1 5/2009 Nibler et al.

OTHER PUBLICATIONS

Jandy Water Purification System Power Center and Cell Kit, Jandy Installation and Operation Manual [online], Jandy Pool Products, Inc., Dec. 15, 2006 [Retrieved on Dec. 3, 2008], Retrieved from the internet: URL:http://web.archive.org/web/20061215040826/http://www.jandy-downloads.com/pdfs/PureLink_Manual.pdf, Entire document, especially p. 7, Fig. 1.

JANDY 2007 Catalog, Filters, Jandy Pool Products, Inc., pp. 23-30.

JANDY 2007 Catalog, Filter Parts, Jandy Pool Products, Inc., pp. 31-41.

JANDY 2008 Catalog, Filters, Jandy Pool Products, Inc., pp. 23-31.

JANDY 2008 Catalog, Filter Parts, Jandy Pool Products, Inc., pp. 32-44.

Office Action dated Nov. 18, 2009, Australia Patent Application No. 2008201362, 3 pages.

Office Action dated Jul. 30, 2010, Canada Patent Application No. 2,627,178, 3 pages.

* cited by examiner

METHODS AND APPARATUS FOR A POOL TREATMENT AND WATER SYSTEM

CROSS-REFERENCE TO RELATED APPLICATIONS

This application claims the benefit under 35 U.S.C. §119 (e) of U.S. provisional application No. 60/978,047, entitled "Methods and Apparatus for a Pool Treatment System" and filed on Oct. 5, 2007, and U.S. provisional application No. 60/988,711, entitled "Header for Heat Exchanger" and filed on Nov. 16, 2007, each of which are hereby incorporated by reference herein in their entireties.

FIELD OF INVENTION

The present invention generally relates to pools and spas, and more particularly to pool and spa water treatment and handling systems.

BACKGROUND

In a plumbing system for a pool or spa, many components may be fluidly connected together, including a pool filter, a water heater, heat exchanger, salt chlorine generators and various valves and controllers. The components are fluidly connected together by piping, such as PVC pipe. In operation, the water in the pool flows from the pool, through the plumbing system, including the filter, various valves and pump(s), the water heater, and the chlorine generator (if one is necessary) and other components, and back to the pool.

There are many ways to connect the components to one another. In many systems, however, the design of individual components, such as the pump, filter, valves, heaters and so on, are often not considered within the context of the overall plumbing system, thus leading to an inefficient layout and joining of the components. For example, traditional heat exchanger header structures for pool and spa heaters, such as the one shown in FIG. 9, often have the inlet and outlet ports on the same side and in a common geometric plane with one another. As another example, traditional pool filters also often have the inlet and outlet ports on the same side. These configurations make it more likely to have to use cross-over tubing layouts, and extra angles in the tubing to fluidly connect the heat exchanger and pool filter to the surrounding components.

In other words, little coordination, if any, has previously existed in the pool equipment market to ensure the exit point of one piece of equipment either aligns or matches the entrance point of any other piece of equipment. Hence, the pool plumber has been required to make the connections with custom cut-to-length pipe and a multitude of fittings. The various elevations of plumbing connection points results in the need for additional bends and turns with the associated required fittings, and often reduces hydraulic flow.

SUMMARY OF THE INVENTION

One embodiment of the present invention may take the form of a pool water treatment system including a pump and a pool filter. The pump may include a pump inlet and a pump outlet. The pump inlet and outlet may be aligned within a first vertical plane. The pool filter may be offset a select transverse distance from the pump. The pool filter may include a pool filter inlet in fluid communication with the pump outlet and a pool filter outlet. The pool filter inlet, the pool filter outlet and the pump outlet may be aligned within a second vertical plane that is transverse to the first vertical plane. The pool filter inlet and the pool filter outlet may be positioned at a first elevation. In some embodiments, the first vertical plane may be substantially perpendicular to the second vertical plane.

Another embodiment of the present invention may take the form of a pool water treatment system including a pump and a pool filter. The pump may include a pump inlet and a pump outlet. The pump inlet and pump outlet may be aligned along a first axis. A pool filter may be offset a select transverse distance from the pump. The pool filter may include a pool filter inlet in fluid communication with the pump outlet and may include a pool filter outlet. The pool filter inlet and pool filter outlet may be aligned along a second axis transverse to the first axis. The pump outlet may be positioned on a third axis parallel to and vertically offset from the second axis.

DETAILED DESCRIPTION

Described herein are water treatment systems that may be used for a pool, spa, or the like. These treatment systems may involve incorporating any or all of the following into a pool or spa water system:

1. Controlling inlet and outlet port elevations of the various pieces of pool equipment;
2. Aligning the horizontal dimensions (fore and aft) to minimize crossing of plumbing;
3. Minimizing the overall footprint of the equipment when plumbed to fit on pre-fabricated equipment pads;
4. Providing options (multiple ports, changeable entrance and exit ports, optional plumbing sizes) to ease plumbing for the various equipment pad configurations; and 5. Increasing the size of plumbing between equipment to allow for improved hydraulic performance (e.g., allowing up to 2½ inch plumbing connections compared to standard 2" fittings).

Figure 1:
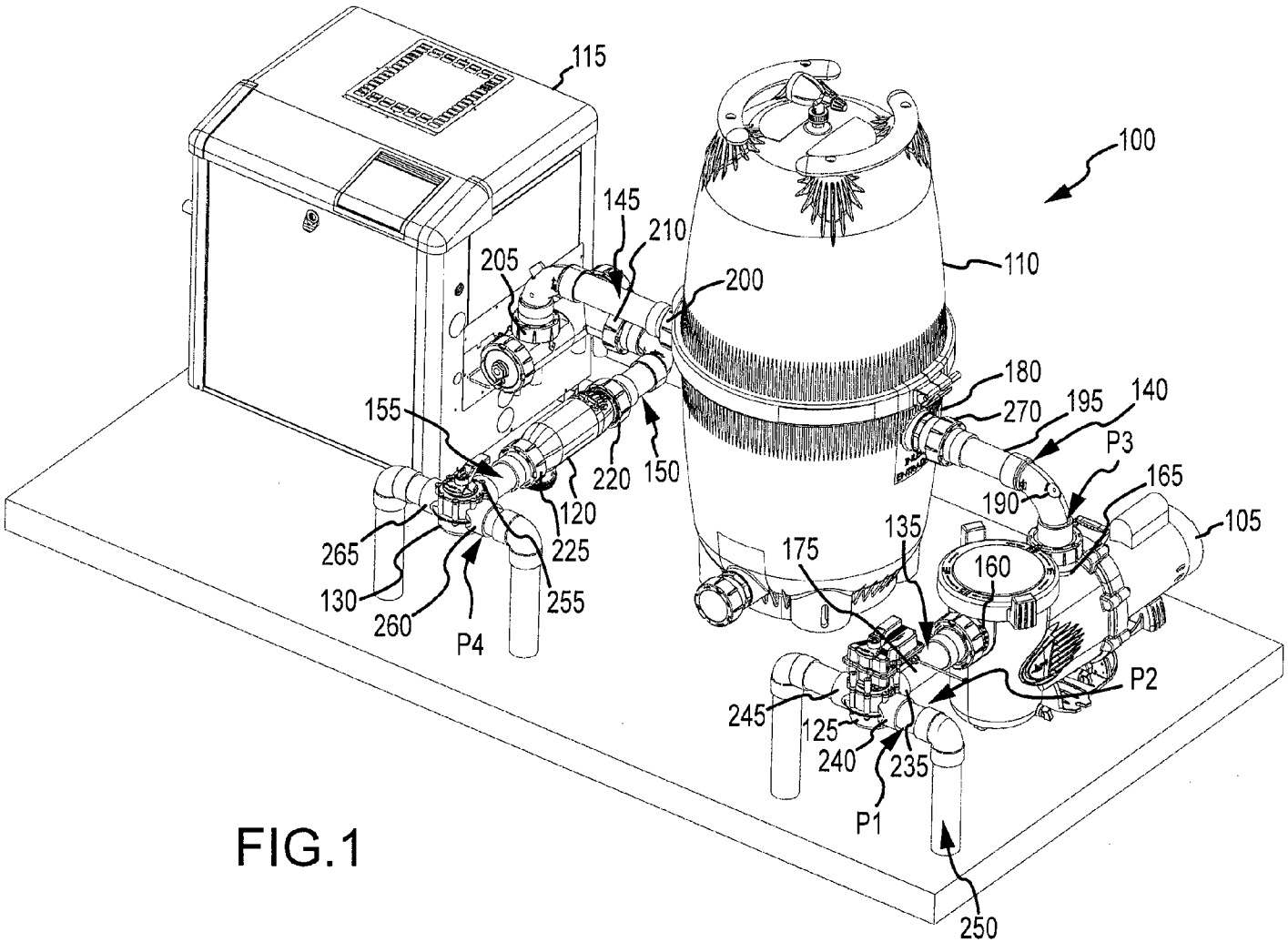
FIG. 1 is a front perspective view of a pool/spa water treatment system.
Figure 2:
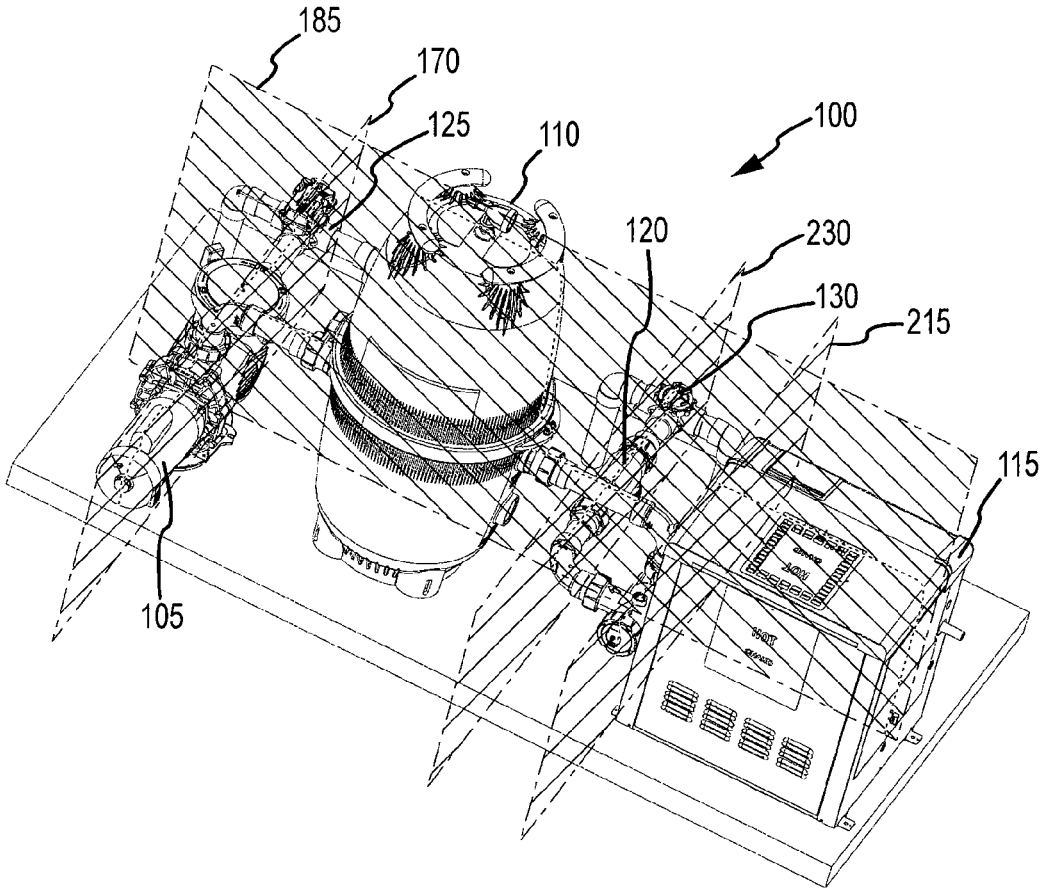
FIG. 2 is a rear perspective view of the pool/spa water treatment system shown in FIG. 1.
Figure 3:
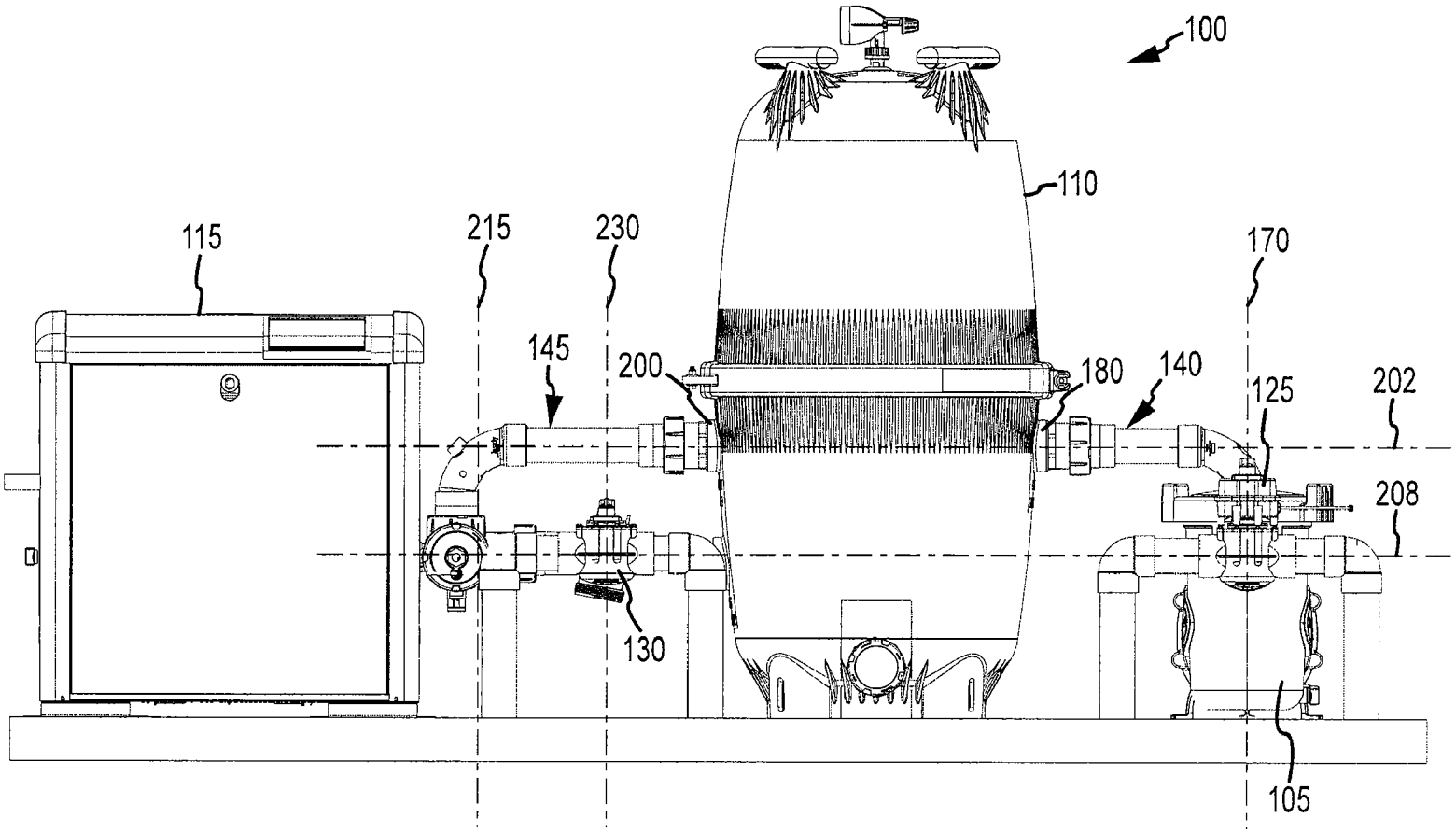
FIG. 3 is a front elevation view of the pool/spa water treatment system shown in FIG. 1.
Figure 4:
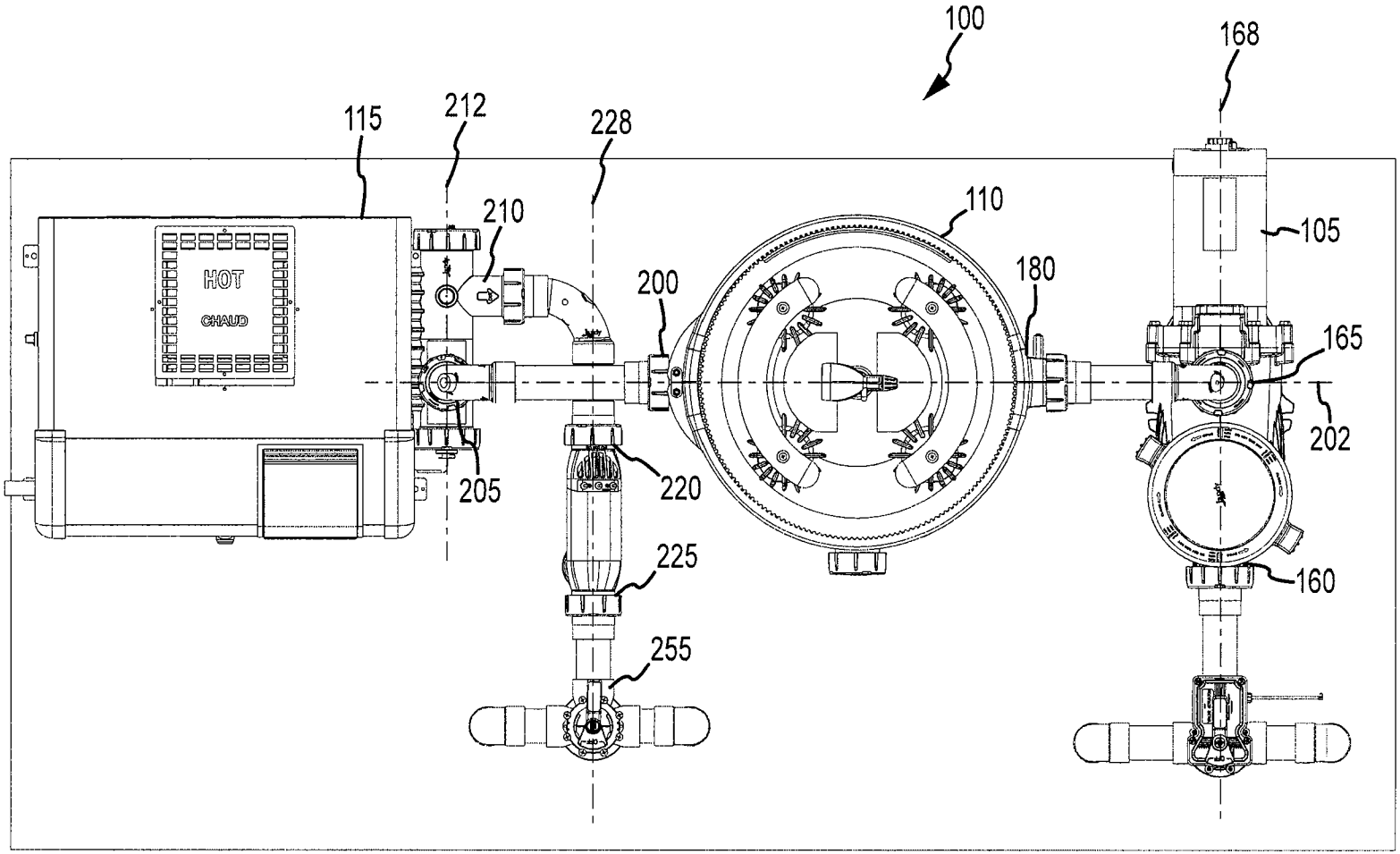
FIG. 4 is a top plan view of the pool/spa water treatment system shown in FIG. 1

FIG. 1 depicts a front perspective view of first embodiment of a pool/spa water treatment system 100, and FIG. 2 depicts a rear perspective view of the pool/spa water treatment system 100 depicted in FIG. 1. FIG. 3 depicts a front elevation view of the pool/spa water treatment system 100 depicted in FIG. 1, and FIG. 4 depicts a top plan view of the pool/spa water treatment system 100 depicted in FIG. 1. With reference to FIGS. 1-4, the pool/spa water treatment system may include a pump 105, a pool filter 110, a heater 115, a chlorine generator 120, piping, and valves 125, 130. An upstream valve 125 may be fluidly connected to one or more water sources, such as a pool or spa (not shown), using piping. The pump 105 may be fluidly connected to the upstream valve 125 via a pump inlet conduit assembly 135 to receive water from the one or more water sources via the upstream valve 125. Further, the pump 105 may be fluidly connected to the pool filter 110 via a pool filter inlet conduit assembly 140. The pool filter 110, in turn, may be fluidly joined to the heater 115 via a heater inlet conduit assembly 145, and the heater 115 may be in fluid communication with the chlorine generator 120 via a chlorine generator inlet conduit assembly 150. The chlorine generator 120 may be in fluid communication with a downstream valve 130 via a chlorine generator outlet conduit assembly 155. The downstream valve 130 may be in fluid communication with one or more fluid receiving bodies or reservoirs, such as pools or spas, via piping.

In operation, the pump 105 draws a fluid, such as water, from one or more fluid sources, such as a pool or spa, in fluid communication with the pump 105 and delivers the fluid to the pool filter 110 for filtering. Within the pool filter 110, sediment and other particles are separated from the fluid to create a filtered fluid. The filtered fluid then flows from the pool filter 110 to the heater 115 for heating the filtered fluid to a desired temperature. The heated and filtered fluid then flows from the heater 115 to the chlorine generator 120. Within the chlorine generator 120, the heated and filtered fluid is chlorinated to disinfect the heated and filtered fluid. The now filtered, heated, and disinfected fluid is then delivered to one or more fluid receiving bodies or reservoirs, such as a pool or spa. The fluid receiving bodies or reservoirs may be the same, or different, than the fluid sources.

The pump 105 may take the form of any pump suitable for use in a pool, spa, or other water system, including, but not limited to, a Stealth pump, a PlusHP pump, or a MaxHp pump, all of which are sold by Jandy Pool Products, Inc. of Moorpark, Calif. and are described in the Jandy Pump Reference Guide, the Stealth Series Pumps Installation and Operation Manual, the Plus HP Series Pumps Installation and Operation Manual, and the Max HP Series Pumps Installation and Operation Manual, which are hereby incorporated herein by reference in their entireties. The pump 105 may be a variable, multiple or fixed speed pump. The pump 105 may include a pump inlet 160 and a pump outlet 165, which may be aligned along a first axis 168, or within a first vertical plane 170. Further, the pump inlet 160 may be positioned at a first elevation. The pump outlet 165 may be positioned at approximately the first elevation. The pump outlet 165 may be offset from the pump inlet 160 by ninety degrees.

The pump inlet conduit assembly 135 may include a pump inlet pipe 175, or other fluid conduit. One end of the pump inlet pipe 175 may be joined to the pump inlet 160 for delivering fluid, such as water, to the pump 105 from a fluid source, such as a pool or spa. The opposite, or distal end, of the pump inlet pipe 175 may be joined to the upstream valve 125, which receives fluid from one or more fluid sources for delivery to the pump inlet pipe 175.

The pump outlet 165 may be joined to the pool filter inlet conduit assembly 140, which delivers fluid to the pool filter 110. The pump outlet 165 may be aligned with a pool filter inlet 180 within a second vertical plane 185, as shown, for example, in FIG. 3. This second vertical plane 185 may be transverse to the first vertical plane 170. In some embodiments, the second vertical plane 185 may be perpendicular to the first vertical plane 170. Such alignment combined with the pump outlet 165 defined on an upper portion of the pump 105 simplifies the piping connection between the pump outlet 165 and the pool filter inlet 180 since the piping plumbs within a common vertical plane. Further, such alignment helps to minimize the number of curved or bent pipe segments required to join the pump outlet 165 to the pool filter inlet 180, which helps to reduce the head/energy losses when transporting the fluid through the piping. More particularly, generally only one sweep elbow 190 is necessary to position one or more linear pipes 195 of the pool filter inlet conduit assembly 140 at the proper elevation for connection to the pool filter inlet 180 in order to fluidly join the pump 105 to the pool filter 110. Yet further, such alignment also minimizes the potential for this piping to cross-over other piping for a given system, thus creating a piping system that is easier to maintain.

The pool filter 110 may take the form of any fluid filter for separating solids and/or particulates from water, including, but not limited to, cartridge, sand, screen and other filters. One possible cartridge-type filter is the pool filter described in U.S. Provisional application Ser. No. 12/053,446, entitled "Pool Filter" and filed on Mar. 21, 2008, the disclosure of which is hereby incorporated herein by reference in its entirety.

The pool filter 110 may include the pool filter inlet 180 and a pool filter outlet 200. The pool filter inlet 180 and pool filter outlet 200 may be positioned on diametrically opposite sides of the pool filter 110. Further, the pool filter inlet 180 and pool filter outlet 200 may be positioned along a second axis 202 and/or within the second vertical plane 185. Yet further, the pool filter inlet 180 and the pool filter outlet 200 may be positioned at approximately a second elevation on the pool filter 110. When the pool/spa water treatment system 100 is assembled, the difference between the first elevation for the pump outlet 165 and the second elevation of the pool filter inlet 180 and outlet 200 may be approximately the height of the elbow 190 joined to the pump outlet 165, thus allowing for one sweep elbow to be used to position a pool filter inlet pipe 195 (or pipes) at the second elevation for fluidly joining the pool filter inlet 180 to the pump outlet 165 via the pool filter inlet conduit assembly 140.

The pool filter inlet 180 may be joined the pool filter inlet conduit assembly 140 to receive fluid from the pump 105. The pool filter outlet 200 may be joined to the heater inlet conduit assembly 145 to deliver filtered water to the heater 115. As shown in FIG. 3 and as discussed above, the pool filter inlet 180 and outlet 200 may be positioned at approximately the same elevation on the pool filter 110. Further, the pool fluid inlet 180 and outlet 200 may be approximately the same size. Such a configuration and arrangement allows for the pool filter inlet 180 and outlet 200 to be, with appropriate changes to the internal connections, interchanged, thus providing flexibility in plumbing other components of a pool/spa water treatment system 100, such as a heater 115 or pump 105, to the pool filter 110. Further, similar to the alignment of the pump outlet 165 with the pool filter inlet 180, the pool filter outlet 200 may be aligned with the heater inlet 205 within the second vertical plane 185, as shown, for example, in FIG. 2. As described in more detail above with respect to the pump outlet 165 and the pool filter inlet 180, such an alignment simplifies the piping connection between the pool filter outlet 200 and the heater inlet 205, helps to reduce head/energy losses within the pool/spa water treatment system 100 (i.e., results in a system that is more efficient and/or requires less energy to pump water through it), and potentially creates an easier to maintain piping system.

The heater 115 may take the form of any suitable water heater for a pool, spa, or other fluid system. One possible heater is the LXi gas-fired pool and spa heater, sold by Jandy Pool Products, Inc. of Moorpark, Calif. The LXi gas-fired pool and spa heater is described in the Model LXi Natural Gas and LP Installation and Operation Manual, which is hereby incorporated herein by reference in its entirety.

The heater 115 may include the heater inlet 205 for receiving fluid from the pool filter 110 and a heater outlet 210. As described above, the heater inlet 205 and the pool filter outlet 200 may be aligned within the second vertical plane 185. Further, the heater inlet 205 may be positioned at a third elevation. Yet further, the heater inlet 205 may be aligned with the pump outlet 165 along a third axis 208. This third axis 208 may be parallel to and vertically offset from the second axis 202. When the system is assembled, the third elevation for the heater inlet 205 may be at approximately the same elevation as the first elevation for the pump outlet 165 as shown, for example, in FIG. 3.

By positioning the heater inlet 205 and pump outlet 165 at a common elevation, and by also positioning the pool filter inlet 180 and the pool filter outlet 200 at the second elevation, similarly sized elbows or other curved piping for the pool filter inlet conduit assembly 140 and the heater inlet conduit assembly 145 that redirect the fluid flow from a substantially horizontal flow to a substantially vertical flow, or vice versa, may be used. The ability to use similar sized components results in cost efficiencies since multiple components of the same size can be reproduced rather than requiring either field modification or multiple tooling to be used to create different sized components. The use of similarly sized components also creates installation efficiencies since the installer can use any component of the same type rather than potentially install differently sized, but similar components, at the wrong place in the system, thus requiring undoing the installation in order to install the right component at the right location.

The heater outlet 210 may be positioned at approximately the same elevation as the heater inlet 205 (i.e., at approximately the third elevation). Positioning the heater outlet 210 at approximately the third elevation allows for ease in installing pool/spa water treatment system components downstream of the heater outlet 210, such as a chlorine generator 120, since the chlorine generator inlet conduit assembly 150, as shown, for example, in FIG. 1, will generally be at a different elevation than the heater inlet conduit assembly 145. Further, the heater inlet 205 and the heater outlet 210 may be positioned along a fourth axis 212, or within a third vertical plane 215. The fourth axis 212 or third vertical plane 215 may be transverse to the second axis 202 or second vertical plane 185, respectively. In some embodiments, the fourth axis 212 or third vertical plane 215 may be perpendicular to the second axis 202 or second vertical plane 185, respectively. In such embodiments, the fourth axis 212 or third vertical plane 215 may be generally parallel to the first axis 168 or first vertical plane 170, respectively.

The chlorine generator 120 may take the form of any suitable system for chlorinating fluid in a pool, spa, or other fluid system. One possible chlorine generator is the chlorine generator described in U.S. patent application Ser. No. 11/346,650, entitled "Multi-Port Chlorine Generator" and filed on Feb. 3, 2006, the disclosure of which is incorporated herein by reference in its entirety.

The chlorine generator 120 may include a chlorine generator inlet 220 for receiving fluid from the heater 115. The chlorine generator 120 may further include a chlorine generator outlet 225 for delivering chlorinated fluid from the chlorine generator to the downstream valve 130 for distribution to water bodies or reservoirs, such as pool or spa reservoirs. The chlorine generator inlet 220 and the chlorine generator outlet 225 may be positioned at a fourth elevation. When the pool/spa water treatment system 100 is assembled, the fourth elevation may be approximately the same as the first and/or third elevations. When the third and fourth elevations are approximately the same, elbows or other bent piping elements are not needed to change to elevation of the piping for the chlorine generator inlet conduit assembly 155 used to join the chlorine generator inlet 220 to the heater outlet 210. Yet further, the chlorine generator inlet 220 and the chlorine generator outlet 225 may be aligned along a fifth axis 228, or within a fourth vertical plane 230. The fifth axis 228 or fourth vertical plane 230 may be transverse to the second axis 202 or second vertical plane 185, respectively. In some embodiments, the fifth axis 228 or fourth vertical plane 230 may be generally perpendicular to the second axis 202 or second vertical plane 185, respectively. In such embodiments, the fifth axis 228 or fourth vertical plane 230 may be generally parallel to either or both of the first and fourth axes 168, 212 or the first and third vertical planes 170, 215, respectively.

The upstream valve 125 may take the form of a diverter valve. A possible diverter valve for use in the pool/spa water treatment system 100 is described in U.S. patent application Ser. No. 11/681,015, entitled "Diverter Valve" and filed on Mar. 1, 2007, the disclosure of which is hereby incorporated herein by reference in its entirety. However, any type of diverter or other suitable valve may be used. Further, the number of inlets and outlets may be more or less than three. Yet further, the valve may be closed manually, or may be configured to close automatically used an actuator, such as a Jandy Valve Actuator manufactured by Jandy Pool Products of Moorpark, Calif. Still yet further, the valve may operatively connected to a controller or other control system for controlling the opening and closing of the various fluid communications within the pool/spa water treatment system 100 using the diverter valve or the like.

With continued reference to FIGS. 1 and 2, the diverter valve may include a diverter valve outlet 235 or port fluidly connected to the pump inlet pipe 175 for delivering fluid from the diverter valve to the pump inlet pipe 175. The diverter valve may also include two diverter valve fluid inlets 240, 245 with each diverter valve fluid inlet fluidly connected to a diverter valve inlet conduit assembly 250 for delivering fluid to the diverter valve from fluid sources remote from the diverter valve. The diverter valve may further include a handle joined to a valve closing member (not shown) contained with a fluid chamber (also not shown) defined by a diverter valve body. The handle may be selectively moved to open or close fluid communication, using the valve closing member, between the fluid chamber and the various inlets and/or outlets that receive and deliver fluid to and from the diverter valve via the fluid chamber.

The diverter valve inlets 240, 245 and outlet 235 may be positioned at a fifth elevation. When the pool/spa water treatment system 100 is assembled, the fifth elevation may be approximately the same as the first elevation. Such positioning allows the diverter valve outlet 235 to be joined to the pump inlet 160 without the use of any elbows or the like to change the vertical location of the pump inlet pipe 175 (or pipes) that fluidly join the diverter valve outlet 235 to the pump inlet 160. Yet further, the diverter valve outlet 235 and the pump inlet 160 may be aligned along the first axis 168 or within the first vertical plane 170.

Valves other than diverter valves may also be used for the upstream valve 125. For example, the diverter shown in the figures may be replaced with a check valve. Possible check valves for use in the pool/spa water treatment system 100 are described in U.S. Pat. Nos. 4,470,429 and 6,247,489, the disclosures of which are incorporated herein by reference in their entireties. However, any type of check valve, or other type of valve, may be used.

Figure 5:
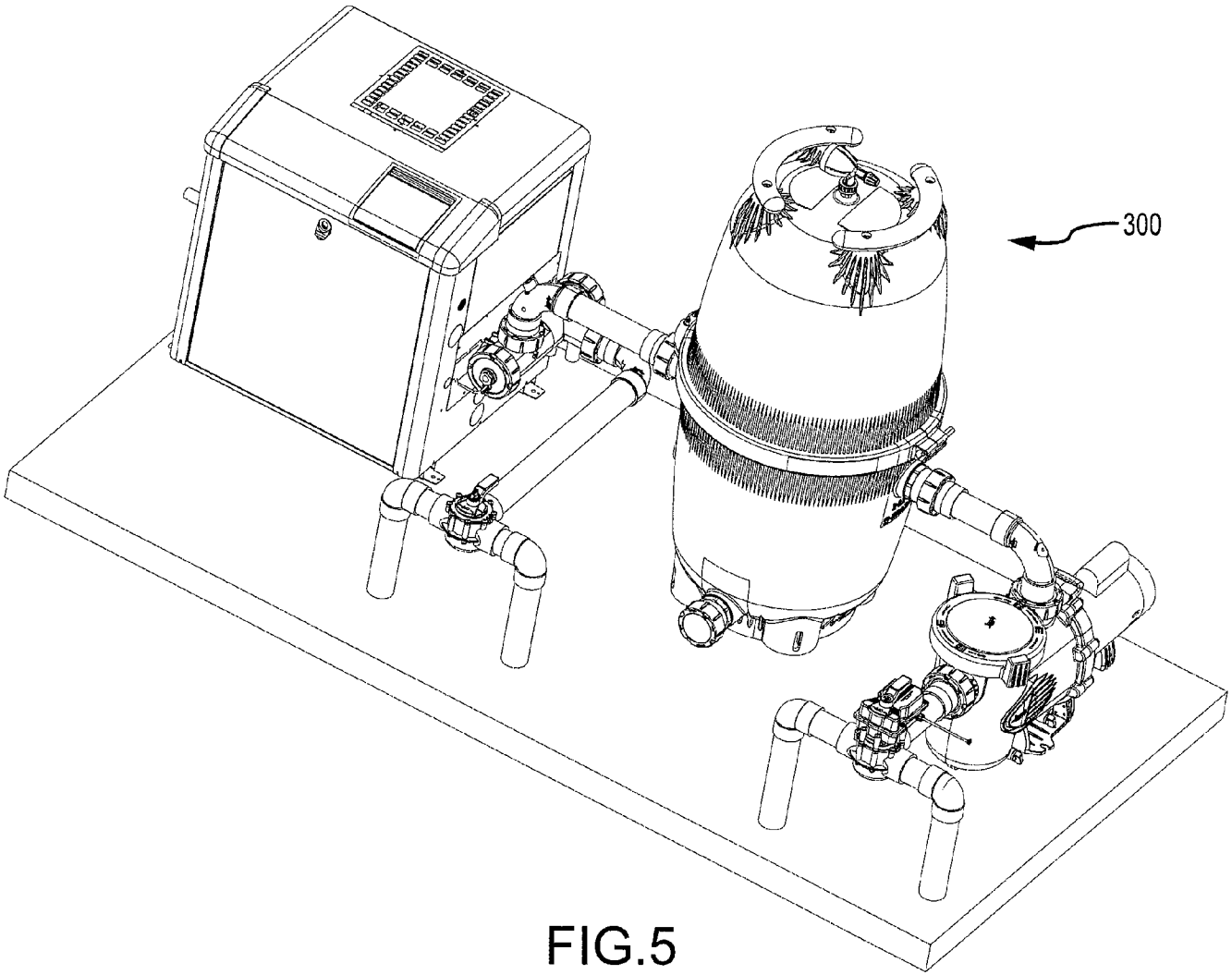
FIG. 5 is a front perspective view of another embodiment of a pool/spa water treatment system.

The downstream valve 130 may be substantially similar to the upstream valve 125. However, the downstream valve 130 may include one inlet 255 for receiving fluid from the chlorine generator 120 (or from another component of the pool/spa water treatment system, such as the heater 115 as shown in FIG. 5, or the pool filter 110), and two outlets 260, 265 in fluid communication with a pool, spa or other water receiving system. The downstream valve inlet 255 and outlets 260, 265 may be positioned at a sixth elevation. When the system is assembled, the sixth elevation may be approximately the same as the fourth elevation for the chlorine generator inlet 220 and outlet 225. Such positioning allows the downstream valve inlet 255 to be joined to the chlorine generator outlet 225 without the use of any elbows or the like to change the vertical location of the piping for the chlorine generator outlet conduit assembly 155 that fluidly joins the downstream valve inlet 255 to the chlorine generator outlet 225. Yet further, the downstream valve inlet 255 and the chlorine generator outlet 225 may be aligned along the fifth axis 228 or within the fourth vertical plane 230.

The pool filter inlet conduit assembly 145 may include two or more piping components or segments, with one end portion of the pool filter inlet conduit assembly 140 joined to the pump outlet 165 and the other end portion joined to the pool filter inlet 180. With reference to FIGS. 1 and 2, the pool filter inlet conduit assembly 140 may include the sweep elbow 190 and the linear pipe 195. A first substantially linear portion of the sweep elbow 190 extends upward from the pump outlet 165 and then curves in a sweeping arc to place a second substantially linear portion of the sweep elbow 190 at substantially the same elevation as the pool filter inlet 180. From this curved portion, the sweep elbow 190 extends laterally away from the pump 105 and towards the pool filter inlet 180, where it is joined to the linear pipe 195. The linear pipe 195, which may be positioned at substantially the same vertical elevation as the pool filter inlet 180 (i.e., at the second elevation), extends from the sweep elbow 190 to the pool filter inlet 180. At the pool filter inlet 180, the linear pipe 195 is joined to the pool filter inlet 180 using a coupling member 270, such as a threaded coupling nut, or by any other suitable connection method, including, but not limited to, press fitting, heat or sonic welding, adhering, and so on.

The heater inlet conduit assembly 145 may be similar to the pool filter inlet conduit assembly 140 (i.e., the heater inlet conduit assembly 145 may include an elbow, such as a 90 degree or sweep elbow, or other curved piping component, one or more linear pipes and one or more coupling members) except one end portion is joined to the pool filter outlet 200 and the other end is joined to the heater inlet 205. The chlorine generator inlet conduit assembly 150 may also be similar to the pool filter inlet conduit assembly 140 (i.e., the chlorine generator inlet conduit assembly 150 may include an elbow, such as a 90 degree or sweep elbow, or other curved piping component, one or more linear pipes and one or more coupling members) except one end portion is joined to the heater outlet 210 and the other end portion is joined to the chlorine generator inlet 220. The chlorine generator outlet conduit assembly 155 may include a linear pipe and coupling members for joining the linear pipe to the chlorine generator outlet 225 and the downstream valve inlet 255.

The inlets and outlets for the valves 125, 130, the pump 105, the pool filter 110, the heater 115, and the chlorine generator 120 may each be approximately the same size. By using a similar size for each of the inlets and outlets, the piping and other plumbing fluidly joining the various components of the pool/spa water treatment system 100 may be standardized. Such standardization may result in both manufacturing and installation efficiencies for similar reasons described above with respect to the elbows used for changing fluid direction. Further standardization results by arranging the components of the pool/spa water treatment system 100 within a predetermined area (or on a predetermined pad size) in a consistent and repeatable layout, which allows for the same number and length of piping components to be used to join the components together for each installed pool/spa water treatment system 100.

Figure 6:
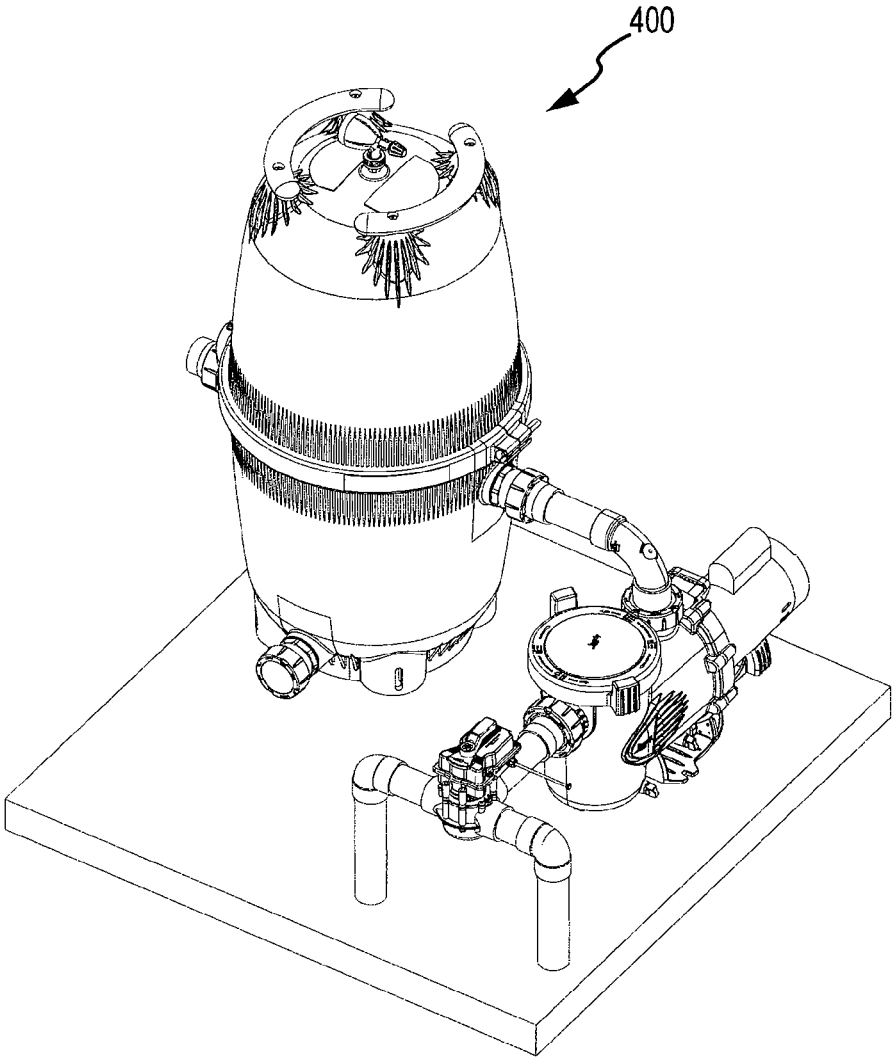
FIG. 6 is a front perspective view of yet another embodiment of a pool/spa water treatment system.

FIG. 5 depicts a second embodiment of a pool/spa water treatment system 300. The second embodiment is similar to the first embodiment except the chlorine generator and associated plumbing/piping are omitted. FIG. 6 depicts a third embodiment of a pool filter treatment system 400. The third embodiment is similar to the first embodiment, except the chlorine generator, the heater, and associated plumbing/piping are omitted.

Figure 7:
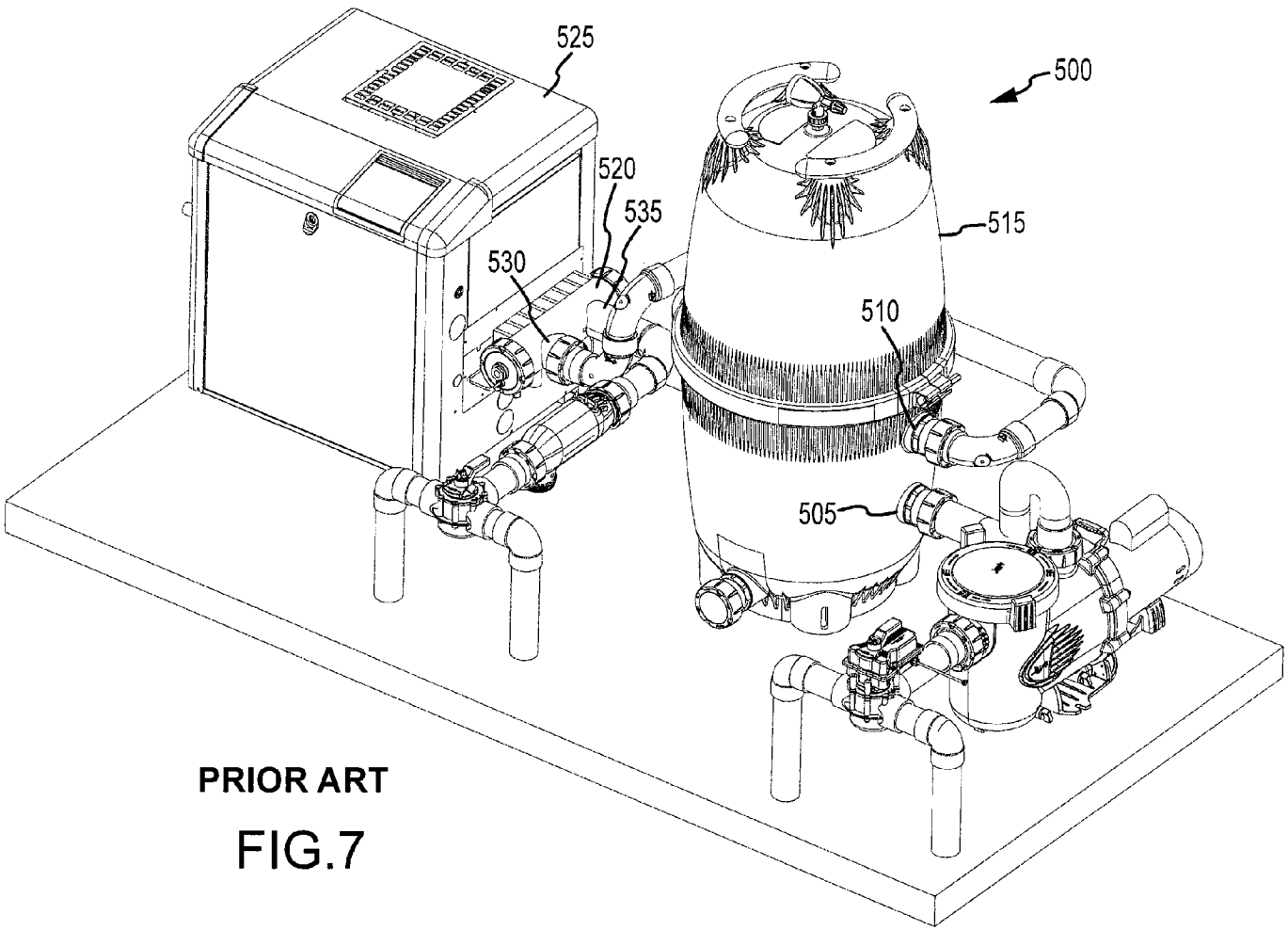
PRIOR ART FIG.7
FIG. 7 is a front perspective view of a pool/spa water treatment system with a conventional layout.

FIG. 7 depicts a prior art pool/spa water treatment system 500 showing the piping in a conventional layout. In particular, the inlet 505 and outlet 510 for the pool filter 515 are located on the same side of the pool filter 515, and the header 520 for the heater 525 is a conventional header, such as the header 520 shown in FIG. 9. Because of the location of these pool filter inlet 505 and outlet 510 on the pool filter 515 and the orientation of the header inlet 530 and outlet 535, additional elbows and piping are required to deliver water from the pool filter outlet 510 to the heater inlet 530 as compared to the first embodiment of the pool/spa water treatment system 100.

Figure 9:
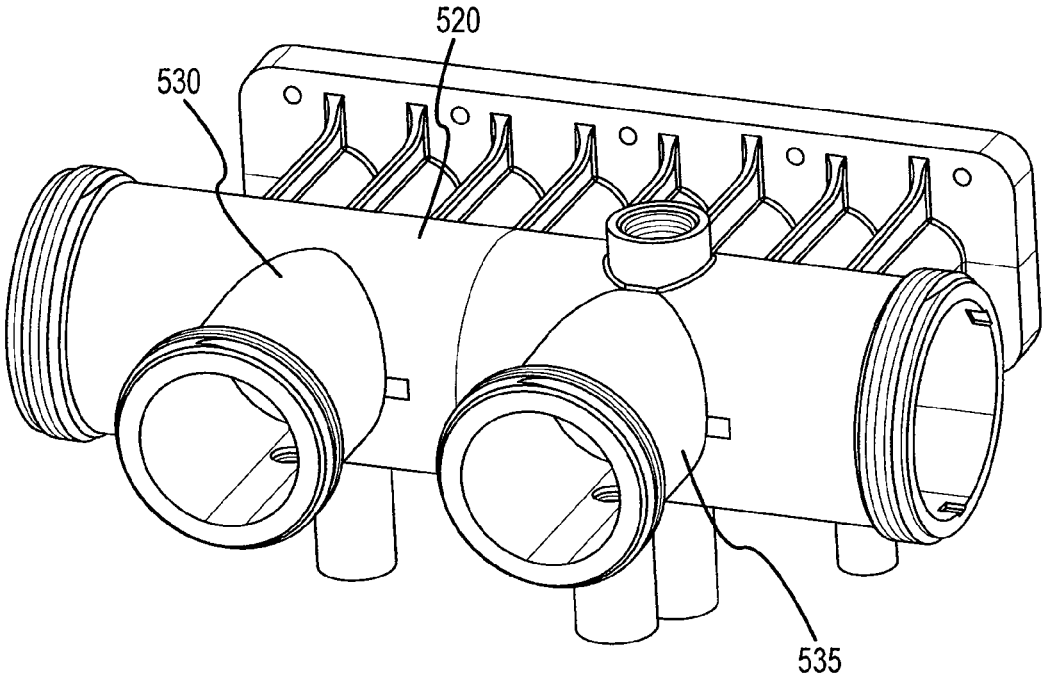
PRIOR ART FIG.9
FIG. 9 shows a heat exchanger header having a conventional configuration.
Figure 10:
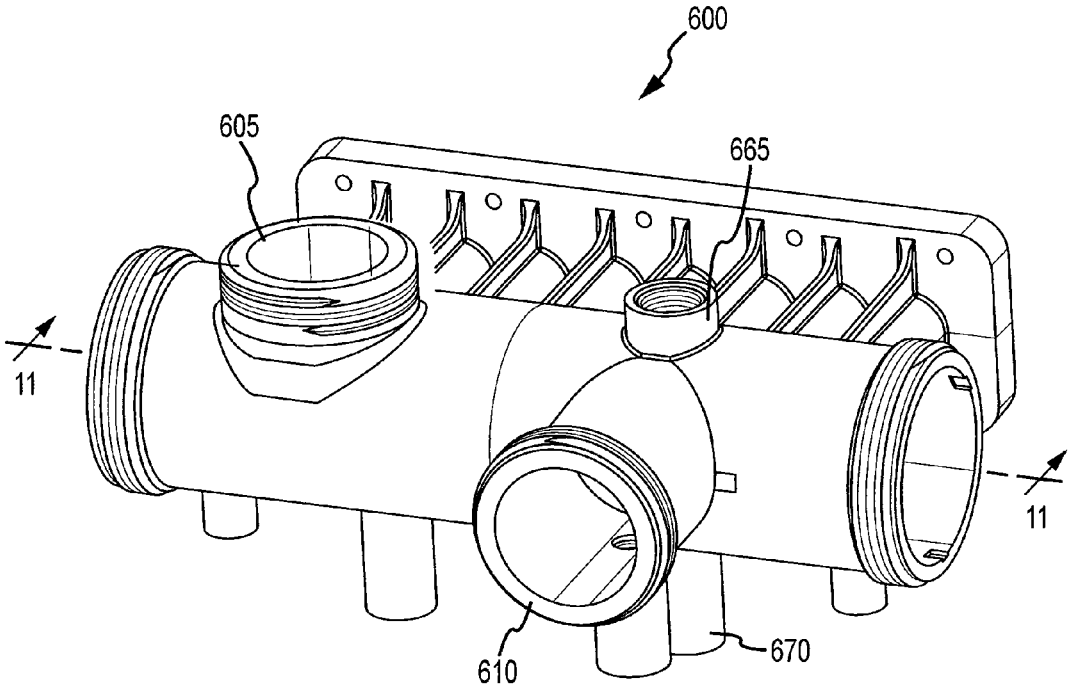
FIG. 10 shows an embodiment of a heat exchanger header.

To compare the efficiencies of these two pool/spa water treatment systems 100, 500, each system was modeled using the same components for the pump, pool filter, heat exchanger, chlorine generator, valves, and using the same diameter openings and fluid passages for piping and elbows. However, in the conventional system 500 setup, a conventional header 520, as shown in FIG. 9, for the heater was used, while in the first embodiment 100 setup, a header as shown in FIGS. 1 and 10 and as described in more detail below was used to supply and receive water from the heater. Further, in the conventional system 500 setup, the pool filter inlet and outlet were positioned on the same side of the pool filter. As a result of these differences between the two systems, the conventional system required nine elbow or curved pipe components compared to three elbow or curved pipe components for the first embodiment of the pool/spa water treatment system 100 in order to fluidly connect the pump, pool filter, heater, and chlorine generator. Further, to fit the components of the conventional system 500 within an area similar to that of the first embodiment of the pool/spa water treatment system 100, the conventional system required extensive use of ninety degree elbows. In contrast, sweep elbows rather than ninety degree elbows could generally be used in the first embodiment of the pool/spa water treatment system 100 for the area available for setting up the pool/spa water treatment system.

To determine the head loss in each system, pressure gauges were placed upstream of the upstream valve (P1), between the upstream valve and the pump inlet (P1), between the pump outlet and the pool filter inlet (P3), and downstream of the downstream valve (P4). The pressure at these points were measured for each system at various flow rates. The head loss for each flow rate was calculated using the following equation: [(P1−P2)+(P3−P4)]*2.3067. Table 1 below summarizes the measured pressures and the calculated head loss at various flow rates for the first embodiment of the pool/spa water treatment system 100, and Table 2 below summarizes the measured pressures and the calculated head loss at various flow rates for the conventional pool/spa water treatment system 500. The head loss vs. flow rate for each system as shown in Tables 1 and 2 is plotted on the graph shown in FIG. 8.

TABLE 1

Flow Rate vs. Head Loss
1st Embodiment of Pool/Spa Water Treatment System

| Flow (gpm) | P1 (psi) | P2 (psi) | P3 (psi) | P4 (psi) | Head Loss (feet) |
|---|---|---|---|---|---|
| 159.2 | 0.04 | −0.52 | 17.00 | 3.57 | 32.3 |
| 150.9 | 0.04 | −0.50 | 18.78 | 6.54 | 29.5 |
| 139.2 | 0.04 | −0.49 | 21.01 | 10.17 | 26.2 |
| 129.5 | 0.15 | −0.36 | 23.89 | 14.61 | 22.6 |
| 121.7 | 0.33 | −0.11 | 25.82 | 17.58 | 20.0 |
| 109.7 | 0.58 | 0.26 | 28.24 | 21.37 | 16.6 |
| 100.1 | 0.78 | 0.49 | 30.37 | 24.49 | 14.3 |
| 92.9 | 0.92 | 0.69 | 31.74 | 26.81 | 11.9 |
| 80.5 | 1.10 | 0.97 | 33.53 | 29.53 | 9.5 |
| 71.4 | 1.25 | 1.19 | 35.00 | 31.96 | 7.2 |
| 59.6 | 1.38 | 1.36 | 35.99 | 33.70 | 5.3 |
| 50.9 | 1.48 | 1.45 | 36.50 | 34.67 | 4.3 |
| 39.7 | 1.59 | 1.64 | 37.09 | 35.80 | 2.9 |
| 29.3 | 1.66 | 1.73 | 37.13 | 36.32 | 1.7 |
| 20.8 | 1.69 | 1.75 | 36.75 | 36.27 | 1.0 |

TABLE 2

Flow Rate vs. Head Loss
Conventional Pool/Spa Water Treatment System

| Flow (gpm) | P1 (psi) | P2 (psi) | P3 (psi) | P4 (psi) | Head Loss (Feet) |
|---|---|---|---|---|---|
| 141.0 | −0.38 | −2.03 | 20.80 | 3.39 | 44.0 |
| 130.6 | −0.08 | −1.84 | 23.51 | 8.50 | 38.7 |
| 119.8 | 0.17 | −1.29 | 26.03 | 13.29 | 32.8 |
| 110.4 | 0.40 | −0.94 | 28.27 | 17.22 | 28.6 |
| 101.0 | 0.59 | −0.42 | 30.33 | 20.67 | 24.6 |
| 89.5 | 0.80 | 0.14 | 32.48 | 24.53 | 19.8 |
| 78.6 | 0.96 | 0.40 | 33.99 | 27.51 | 16.3 |
| 70.9 | 1.11 | 0.63 | 35.12 | 29.66 | 13.7 |
| 60.6 | 1.22 | 0.92 | 35.93 | 31.68 | 10.5 |
| 50.5 | 1.32 | 1.14 | 36.45 | 33.09 | 8.1 |
| 39.6 | 1.41 | 1.24 | 36.73 | 34.09 | 6.5 |
| 29.9 | 1.50 | 1.45 | 36.39 | 34.91 | 3.5 |
| 20.3 | 1.54 | 1.58 | 36.62 | 36.00 | 1.3 |

Additionally, the power required to move fluid through each system was also recorded at various flow rates for each system. Table 3 below summarizes the power required at various flow rates for the first embodiment of the pool/spa water treatment system 100, and Table 4 below summarizes the power required at various flow rates for the conventional pool/spa water treatment system 500. The required power vs. flow rate for each system as shown in Tables 3 and 4 is also plotted on the graph shown in FIG. 8.

TABLE 3

Flow Rate vs. Power
1st Embodiment of Pool/Spa Water Treatment System

| Flow (gpm) | Power (watts) |
|---|---|
| 159.2 | 2130 |
| 150.9 | 2110 |
| 139.2 | 2090 |
| 129.5 | 2065 |
| 121.7 | 2035 |
| 109.7 | 1995 |
| 100.1 | 1940 |
| 92.9 | 1890 |
| 80.5 | 1815 |
| 71.4 | 1730 |
| 59.6 | 1650 |
| 50.9 | 1570 |
| 39.7 | 1440 |
| 29.3 | 1330 |
| 20.8 | 1245 |

TABLE 4

Flow Rate vs. Power
Conventional Pool/Spa Water Treatment System

| Flow (gpm) | Power (watts) |
|---|---|
| 141.0 | 2195 |
| 130.6 | 2145 |
| 119.8 | 2100 |
| 110.4 | 2035 |
| 101.0 | 1985 |
| 89.5 | 1895 |
| 78.6 | 1815 |
| 70.9 | 1735 |
| 60.6 | 1625 |
| 50.5 | 1525 |
| 39.6 | 1420 |
| 29.9 | 1310 |
| 20.3 | 1215 |

Figure 8:
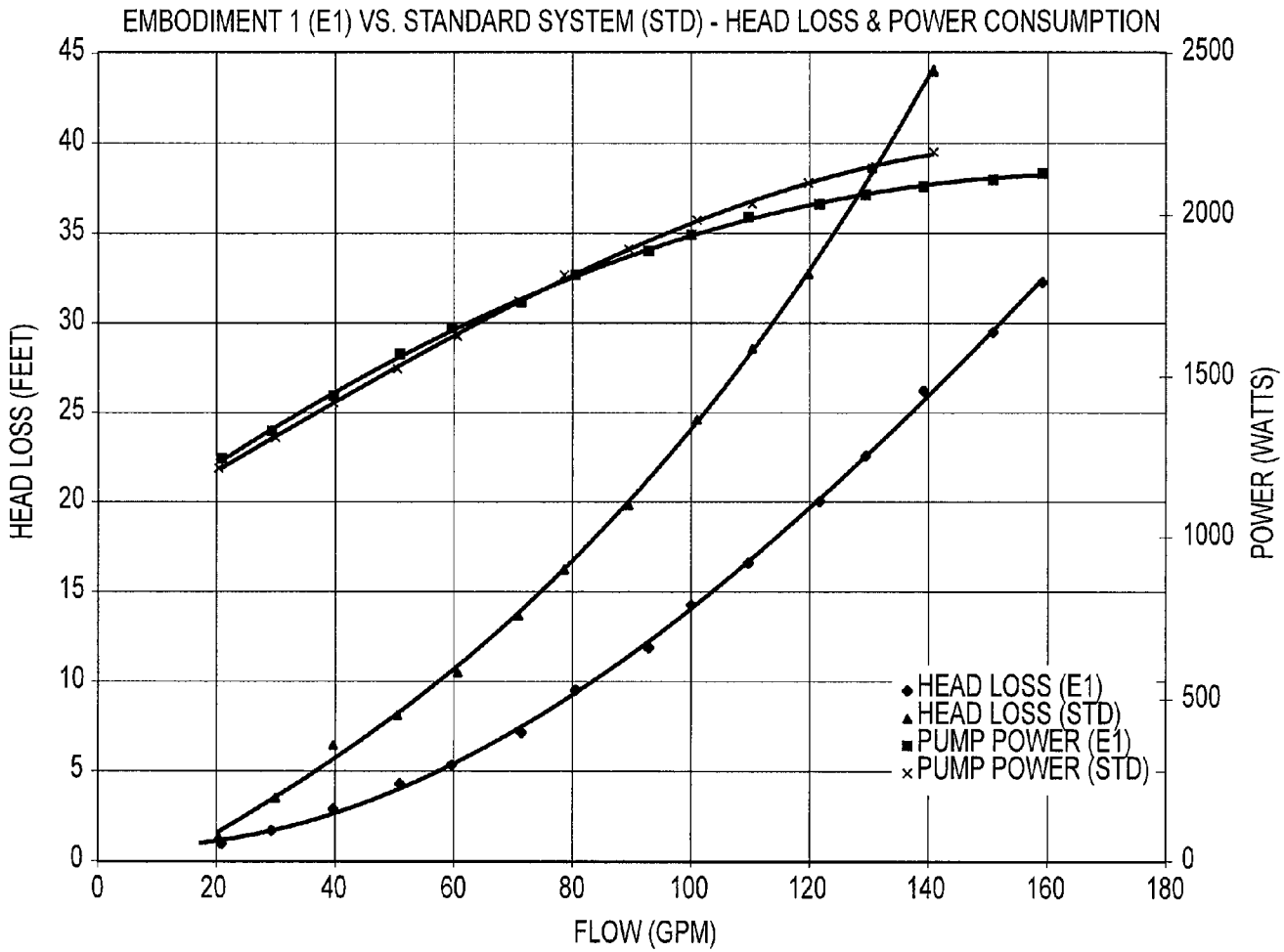
FIG. 8 is a graph showing the head loss and power required for the inventive pool/spa water treatment system described herein and the pool/spa water treatment system of FIG. 7 for various flow rates.

With reference to FIG. 8 and Tables 1 and 2, the head loss in the conventional pool/spa water treatment system 500 is greater than the head loss in the first embodiment of the pool/spa water treatment system 100 for all flow rates. Further, as the flow rate increases, the difference in head loss between the conventional system and first embodiment increases. With reference to FIG. 8 and Tables 3 and 4, the required power for the conventional pool/spa water system 500 and the first embodiment of the pool/spa water treatment system 100 is approximately the same for flow rates less than 80 gallons per minute ("g.p.m."). At flow rates above 80 g.p.m., the first embodiment of the pool/spa water treatment system 100 requires less power than the conventional pool/spa water treatment system 500.

In other words, it takes less power for the first embodiment of the pool/spa water treatment system 100 to achieve the same flow rate as the conventional pool/spa water treatment system 500, especially for larger flow rates. Another way of stating this is that at the same power, the first embodiment of the pool/spa water treatment system 100 provides a greater flow rate than the conventional pool/spa water treatment system 500. This, in turn, means that a pool or spa owner can use less overall power to turn-over the water in their pool or spa using the first embodiment of the pool/spa water treatment system 100 compared to the conventional pool/spa water treatment system 500. For example, it is recommended that a pool owner turn-over the water in their pool twice a day. Continuing with the example, for a fixed speed pump, the amount of power supplied by the pump is constant. Because the first embodiment of the pool/spa water treatment system 100 that uses this pump has a higher flow rate for turning over the water in the pool at the given power for the pump than the conventional pool/spa water treatment system 500 that uses the same pump, the first system 100 will turn-over the pool water faster, thus reducing the amount of time and hence the overall power consumed by the pump. As yet another example, for a variable or multiple speed pump, because the pump can supply more water at a given speed in the first embodiment of the pool/spa water treatment system 100 compared to the conventional pool/spa water treatment system 500, the pump can be operated using less overall energy when turning over water at the same rate in each system. Moreover, because pool water should be turned-over twice a day, these time and power savings achieved in the first embodiment of the pool/spa water treatment system 100, whether it utilizes a fixed, multiple or variable speed pump, may be substantial over time.

FIG. 10 shows one implementation of a heat exchanger header 600 for a heater. In this implementation, the heat exchanger header 600 has the inlet and outlet 605, 610 ports aligned at right angles to one another. This offset orientation facilitates more efficient layout of the inlet and outlet tubing connected to these ports 605, 610, respectively; allowing for less cross-over tubing, fewer right-angles, and other possible efficiencies. This layout benefit likely allows the components upstream and downstream of the heat exchanger to be positioned more closely together with simpler piping layouts, allowing for easier access and thus more efficient maintenance and replacement of components.

The offset in the inlet and outlet ports 605, 610, to obtain this advantage, do not need to be separated by ninety degrees only. More or fewer degrees of separation may provide the same benefit, depending on the size of the header structure, the size of the ports, and the size of the tubing used in the layout.

Figure 11:
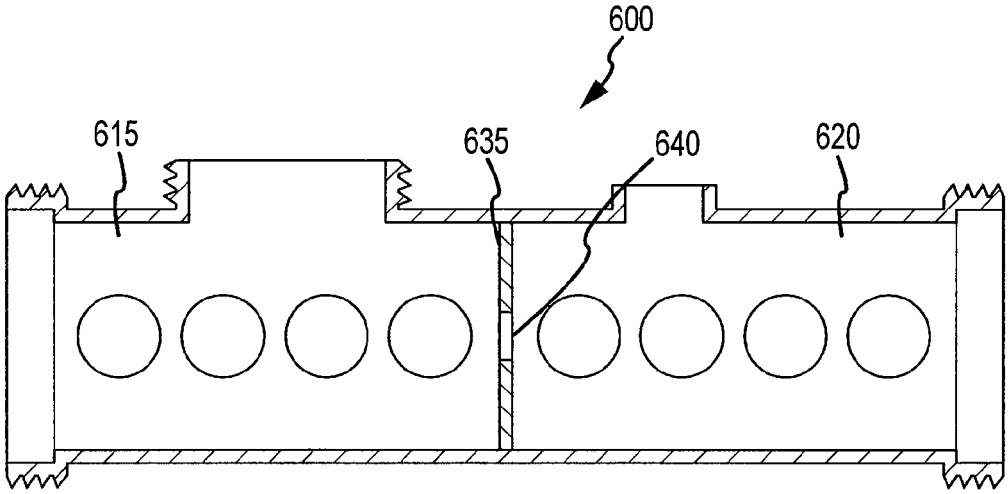
FIG. 11 is a schematic-style cross section taken along line 11-11 of FIG. 10, and shows a schematic of the interior of the heat exchanger header of FIG. 10.
Figure 12:
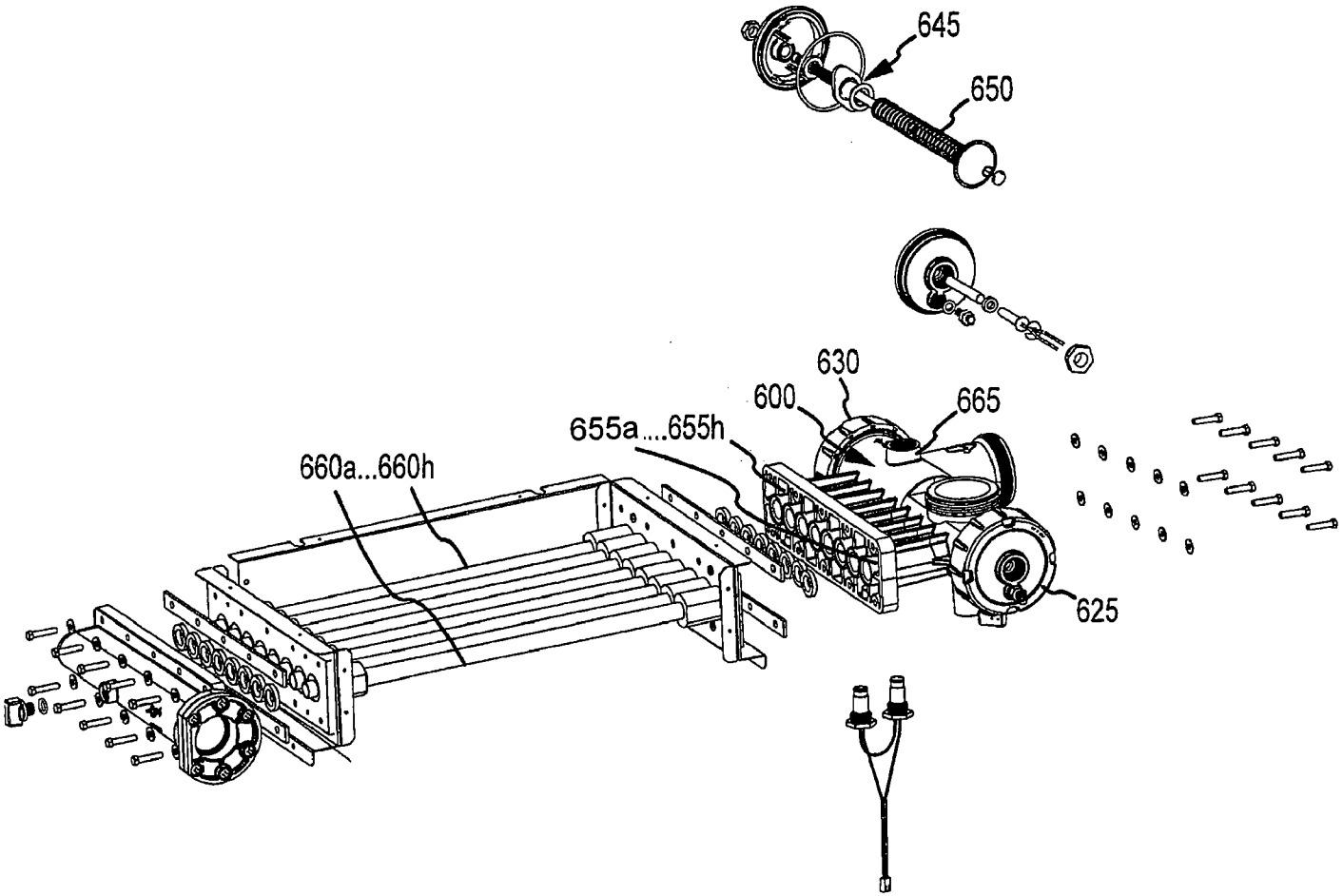
FIG. 12 shows the heat exchanger bypass valve structure, and inlet ports extending off the header and into the heat exchanger, both applicable to the head exchanger header of FIG. 10.

The header 600 defines two chambers separated by an internal wall 635. The inlet chamber 615, with reference to FIGS. 10 and 11, is on the left, and the outlet chamber 620 is on the right. The lateral ends of the inlet chamber 615 and the outlet chamber 620 are sealed off by selectively removable caps 625, 630 (see FIG. 12). In this embodiment the caps 625, 630 are received on the lateral ends by a screw-thread engagement. Other types of engagement may be used, such as press fit, plastic welding, adhesive, epoxy, or other means which may or may not allow the cap(s) to be removed.

The internal wall 635 that separates the inlet and outlet chambers 615, 620 may have an aperture 640 therein (shown in FIG. 11). A bypass valve 645 may be operably associated with the aperture 640 to allow for water to flow directly from the inlet chamber 615 to the outlet chamber 620, bypassing the heat exchanger all together. The bypass valve 645, such as that shown in FIG. 12, may be actuated automatically by reacting to water pressure, water flow speed or external control by a user or automated control system. The bypass valve 645 sensitivity and response characteristics may be altered to adjust its performance. The bypass valve structure 645 in FIG. 12 utilizes a spring force that can be adjusted to affect when the bypass valve 645 is actuated. The bypass valve 645 is attached to the outlet cap 630 used to close off the outlet chamber 620. The bypass valve 645 is positioned over the aperture 640 in the wall when the outlet cap 630 is positioned on the header 600 to enclose the outlet chamber 620. The bypass valve 645 can be adjusted by a user or by an automatic control system by increasing or decreasing the spring force of the spring 650, as is known in the art. One suitable bypass valve 645 is by Jandy Pool Products, Inc. The bypass valve 645 may be associated with the inlet cap 625, or may not be operably associated with either cap, and instead may be configured independent of either the inlet or outlet caps 625, 630.

The inlet cap 625 includes various sensors, such as pressure sensors, temperature sensors, and the like to monitor the flow of water and the condition of the water flowing into the header 600. The outlet cap 630 may include similar sensors.

A plurality of ports 655*a-h* extend off the rear wall of each chamber 615, 620. For the ports 655*a-d* associated with the inlet chamber 615, each of these ports 655*a-d* aligns with a particular inlet tube 660*a-d* in the heat exchanger. For the ports 655*e-h* associated with the outlet chamber 620, each of these ports 655*e-h* aligns with a particular outlet tube 660*e-h* from the heat exchanger. This particular header 600 includes four ports each for the inlet and outlet chambers 615, 620, and is for use on a C-Fin heat exchanger by Jandy Pool Products, Inc. Other configurations of the header 600 may include ports 655 designed to mate with the particular heat exchanger with which the header 600 is to be used.

Other ports may be formed in the header 600 and associated with either or both of the inlet and outlet chambers 615, 620 for various purposes. For instance, the collar 665 formed above the output port 610 from the header 600 is threaded internally (or externally) for receipt of a pressure relief valve. If this collar 665 is to be used, an aperture must be formed through the sidewall of the header 600, inside the collar, to communicate with the outlet chamber 620. The other ports 670 formed in the bottom of the header 600 may be used as drain plugs or for the insertion of other sensors or devices for use with the inlet and/or outlet chambers 615, 620.

Figure 13:
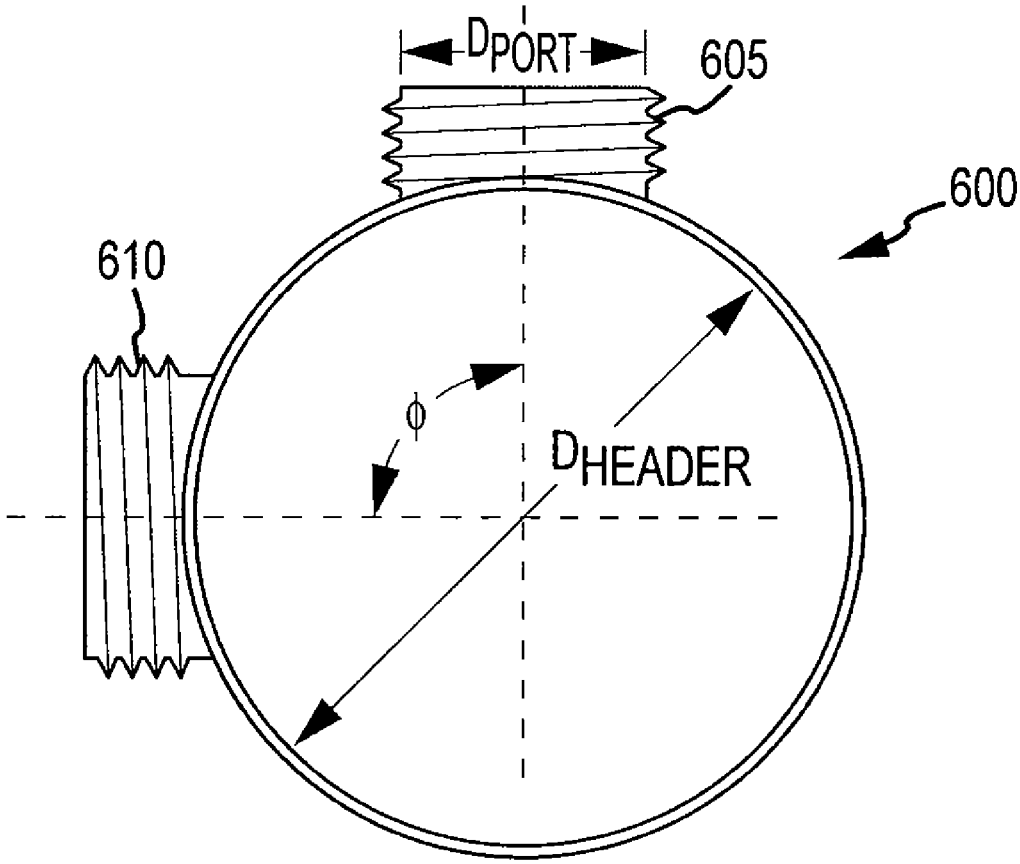
FIG. 13 shows a schematic end view representing the offset nature of the inlet and outlet ports for the header of FIG. 10, and one range of degrees of variance therebetween.

The offset inlet and outlet ports 605, 610 on the header 600 allow the piping attached to each port 605, 610 to be laid out in a more efficient manner, allowing the use of fewer right-angle corner tubes, and more sweep tubes. Also, the configuration of the inlet and outlet ports 605, 610 allows for a piping layout having fewer turns. FIG. 13 shows one example of the range of offset for the inlet and outlet ports. Angle theta in FIG. 13 is shown as 90 degrees. However, angle theta may be less or more than 90 degrees depending on the layout. One benefit of the angle theta being sufficient to keep the inlet port 605 from overlapping the outlet port 610 in this view is that the piping extending from each port can pass by one another without using any additional bends or curves. If the angle theta is small enough (or large enough if angle theta were obtuse in FIG. 13) so that the ports overlapped any amount (hereafter "minimum angle theta"), in this view, this benefit would not be present, however it would still be superior to an arrangement where the inlet and outlet ports were parallel to one another in the same plane as in FIG. 9. The minimum angle theta is dependent upon the size and shape of the port (typically the diameter dimension for a circular port ($D_{port}$)), and the size and shape of the header body (if cylindrical, then the diameter dimension ($D_{header}$)) as in FIG. 13). The ports 605, 610 do not have to have the same diameter, and the header 600 may have a varying cross section along its length, or may not be cylindrical. Either port, the inlet 605 or the outlet 610, may extend directly forward in the configuration of FIG. 10, and the other may be offset. Also, there may be more than one inlet port, or more than one outlet port, or both, on a header 600. The plurality of inlet and outlet ports in this case may be all offset relative to one another, or may be in partial or full alignment based on function.

Some of the benefits of the offset header inlet and outlet ports include, but are not limited to:

a) the ability to control the inlet and outlet port elevations of the various pieces of the pool equipment, in this case the heater equipment, in relation to the filter and/or the salt chlorine generator, and pool valves.

b) align where possible the horizontal dimensions (fore and aft) to ensure the inlet and outlet connections are in different planes so that the plumbing does not need to cross, and special field adjustments are not made; and c) allow for the use of "sweep" elbows for improved hydraulic performance. Sweep elbows are tubing having a smooth curve of 90 degrees (or more or less) with a relatively large radius of curvatures as opposed to a small, tight right-angle shape. The sweep elbows are believed to provide less backpressure and are believed to be more hydraulically efficient.

The piping and plumbing connection for the pool/spa water treatment system 100*s* may be made from any suitable material, including, but not limited to, plastic (e.g., PVC), metal, fiberglass, and so on.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A pool/spa water treatment system, comprising:

a pump including a pump inlet and a pump outlet, the pump inlet and pump outlet aligned within a first vertical plane;

a pool filter offset a select transverse distance from the pump and including a pool filter inlet in fluid communication with the pump outlet and a pool filter outlet;

the pool filter inlet, the pool filter outlet and the pump outlet aligned within a second vertical plane that is transverse to the first vertical plane; and the pool filter inlet and the pool filter outlet are positioned at a first elevation.

2. The pool/spa water treatment system of claim 1, wherein the first vertical plane is substantially perpendicular to the second vertical plane.

3. The pool/spa water treatment system of claim 1, further comprising a heater including a heater inlet in fluid communication with the pool filter outlet, and the heater inlet is aligned with the pump outlet within the second vertical plane.

4. The pool/spa water treatment system of claim 3, wherein the heater inlet is positioned at a second elevation, the heater further includes a heater outlet positioned at approximately the second elevation, the heater inlet and the heater outlet are aligned within a third vertical plane transverse to the second vertical plane, and the heater inlet is offset a select angle relative to the heater outlet.

5. The pool/spa water treatment system of claim 4, wherein the third vertical plane is substantially parallel to the first vertical plane.

6. The pool/spa water treatment system of claim 4, wherein the third vertical plane is substantially perpendicular to the second vertical plane.

7. The pool/spa water treatment system of claim 4, wherein the first elevation is different than the second elevation.

8. The pool/spa water treatment system of claim 4, further comprising a chlorine generator including a chlorine generator inlet in fluid communication with the heater outlet, and the chlorine generator inlet is positioned at approximately the second elevation.

9. The pool/spa water treatment system of claim 8, wherein the chlorine generator further includes a chlorine generator outlet, and the chlorine generator outlet is aligned with the chlorine generator inlet within a fourth vertical plane transverse to the second vertical plane.

10. The pool/spa water treatment system of claim 9, wherein the fourth vertical plane is substantially parallel to at least one of the first and third vertical planes.

11. The pool/spa water treatment system of claim 9, wherein the fourth vertical plane is substantially perpendicular to the second vertical plane.

12. The pool/spa water treatment system of claim 9, further comprising a valve including a valve fluid outlet in fluid communication with the pump inlet, and the valve fluid outlet aligned with the pump inlet within the first vertical plane.

13. The pool/spa water treatment system of claim 9, further comprising a valve including a valve fluid outlet in fluid communication with the pump inlet, and the valve fluid outlet positioned at approximately the second elevation.

14. The pool/spa water treatment system of claim 9, further comprising a valve including a valve fluid inlet in fluid communication with the chlorine generator outlet, and the valve fluid inlet aligned with the chlorine generator outlet within the fourth vertical plane.

15. The pool/spa water treatment system of claim 9, further comprising a valve including a valve fluid inlet in fluid communication with the chlorine generator outlet, and the valve fluid inlet positioned at approximately the second elevation.

16. The pool/spa water treatment system of claim 9, further comprising:

a first valve including a valve fluid outlet in fluid communication with the pump inlet, the valve fluid outlet aligned with the pump inlet within the first vertical plane; and a second valve including a valve fluid inlet in fluid communication with the chlorine generator outlet, the valve fluid inlet aligned with the chlorine generator outlet within the fourth vertical plane.

17. The pool/spa water treatment system of claim 9, further comprising:

a first valve including a valve fluid outlet in fluid communication with the pump inlet, the first valve fluid outlet positioned at approximately the second elevation; and a second valve including a valve fluid inlet in fluid communication with the chlorine generator outlet, the valve fluid inlet positioned at approximately the second elevation.

18. A pool/spa water treatment system, comprising:

a pump including a pump inlet and a pump outlet, the pump inlet and pump outlet aligned along a first axis;

a pool filter offset a select transverse distance from the pump and including a pool filter inlet in fluid communication with the pump outlet and a pool filter outlet;

the pool filter inlet and pool filter outlet aligned along a second axis transverse to the first axis;

the pump outlet positioned on a third axis parallel to and vertically offset from the second axis.

19. The pool/spa water treatment system of claim 18, further comprising a heater including a heater inlet in fluid communication with the pool filter outlet, and the heater inlet is aligned with the pump outlet on the third axis.

20. The pool/spa water treatment system of claim 19, wherein the heater includes a heater outlet, and the heater inlet and the heater outlet are aligned along a fourth axis transverse to the third axis.

* * * * *